United States Patent [19]

Niemi et al.

[11] Patent Number: 4,986,374

[45] Date of Patent: Jan. 22, 1991

[54] APPARATUS FOR DRIVING AN UPWARDLY DIRECTED SHAFT IN ROCK

[75] Inventors: Ingemar Niemi, Malmberget; Lars-Erik Andersson, Gällivare, both of Sweden

[73] Assignee: Gruvprodukter I Gallivare AB, Gallivare, Sweden

[21] Appl. No.: 466,403

[22] PCT Filed: Aug. 29, 1988

[86] PCT No.: PCT/SE88/00441

§ 371 Date: Feb. 28, 1990

§ 102(e) Date: Feb. 28, 1990

[87] PCT Pub. No.: WO89/02025

PCT Pub. Date: Mar. 9, 1989

[30] Foreign Application Priority Data

Aug. 31, 1987 [SE] Sweden ..... 8703370

[51] Int. Cl.[5] ..... E21B 7/00; E21B 41/00

[52] U.S. Cl. ..... 175/86; 175/98; 175/99; 175/230; 405/148

[58] Field of Search ..... 175/86, 219, 97–99, 175/113, 230, 202, 203, 162; 405/138, 145, 148, 288

[56] References Cited

U.S. PATENT DOCUMENTS

| | | | |
|---|---|---|---|
| 3,085,794 | 4/1963 | Johansson et al. | 405/148 |
| 3,379,264 | 4/1968 | Cox | 175/99 |
| 3,547,211 | 12/1970 | Christensen | 175/86 |
| 3,675,433 | 7/1972 | Silvestrov et al. | 405/138 |
| 4,646,853 | 3/1987 | Sugden et al. | 175/99 |

FOREIGN PATENT DOCUMENTS

| | | | |
|---|---|---|---|
| 331071 | 12/1970 | Sweden . | |
| 345299 | 5/1972 | Sweden . | |
| 8002022-5 | 5/1981 | Sweden . | |
| 450587 | 7/1987 | Sweden . | |
| 0532683 | 3/1977 | U.S.S.R. | 405/148 |
| 0945446 | 7/1982 | U.S.S.R. | 175/86 |
| 0968418 | 10/1982 | U.S.S.R. | 175/86 |
| 0979639 | 12/1982 | U.S.S.R. | 175/86 |
| 8807123 | 9/1988 | World Int. Prop. O. | 175/53 |

OTHER PUBLICATIONS

Derwent's abstract No. E8380B/22, SU 615 216, Jun. 1978.

*Primary Examiner*—Bruce M. Kisliuk
*Attorney, Agent, or Firm*—Cushman Darby & Cushman

[57] ABSTRACT

An apparatus for driving an upwardly directed shaft in rock, which includes a platform that can be regulated in height. The platform carries a drilling unit having engageable elements enabling fixation of the drilling unit relative the wall of the shaft. The drilling unit and platform can be separated a given distance such as to form an air gap for preventing the transfer of vibrations from the drilling unit to the platform when a drilling machine pertaining to the drilling unit is in operation. The apparatus has bracket elements and a transverse member for limiting the separation distance between the drilling unit and platform. The platform carries a work station for a drilling machine operator.

5 Claims, 3 Drawing Sheets

APPARATUS FOR DRIVING AN UPWARDLY DIRECTED SHAFT IN ROCK

BACKGROUND OF THE INVENTION

The present invention relates to an apparatus for driving an upwardly directed shaft in rock, and includes a platform that can be regulated in height.

An elevator is normally used in driving an upwardly directed shaft, e.g. a mine raise, and extra sections are added to this elevator so that its reach increases as the length of the raise increases. This kind of elevator has a work platform for carrying an operator and a drilling machine utilised for driving the raise. The vibrations from the drilling machine are transferred to the platform, and thus the operator is also subjected to them.

SUMMARY OF THE INVENTION

The object of the present invention is to provide an apparatus that does not have the mentioned disadvantage.

The invention accordingly provides a vibrationless working environment for the drilling machine operator.

BRIEF DISCRIPTION OF THE DRAWINGS

An embodiment of the invention will now be described with reference to the accompanying drawings, wherein.

DETAILED DESCRIPTION

Figure 1:
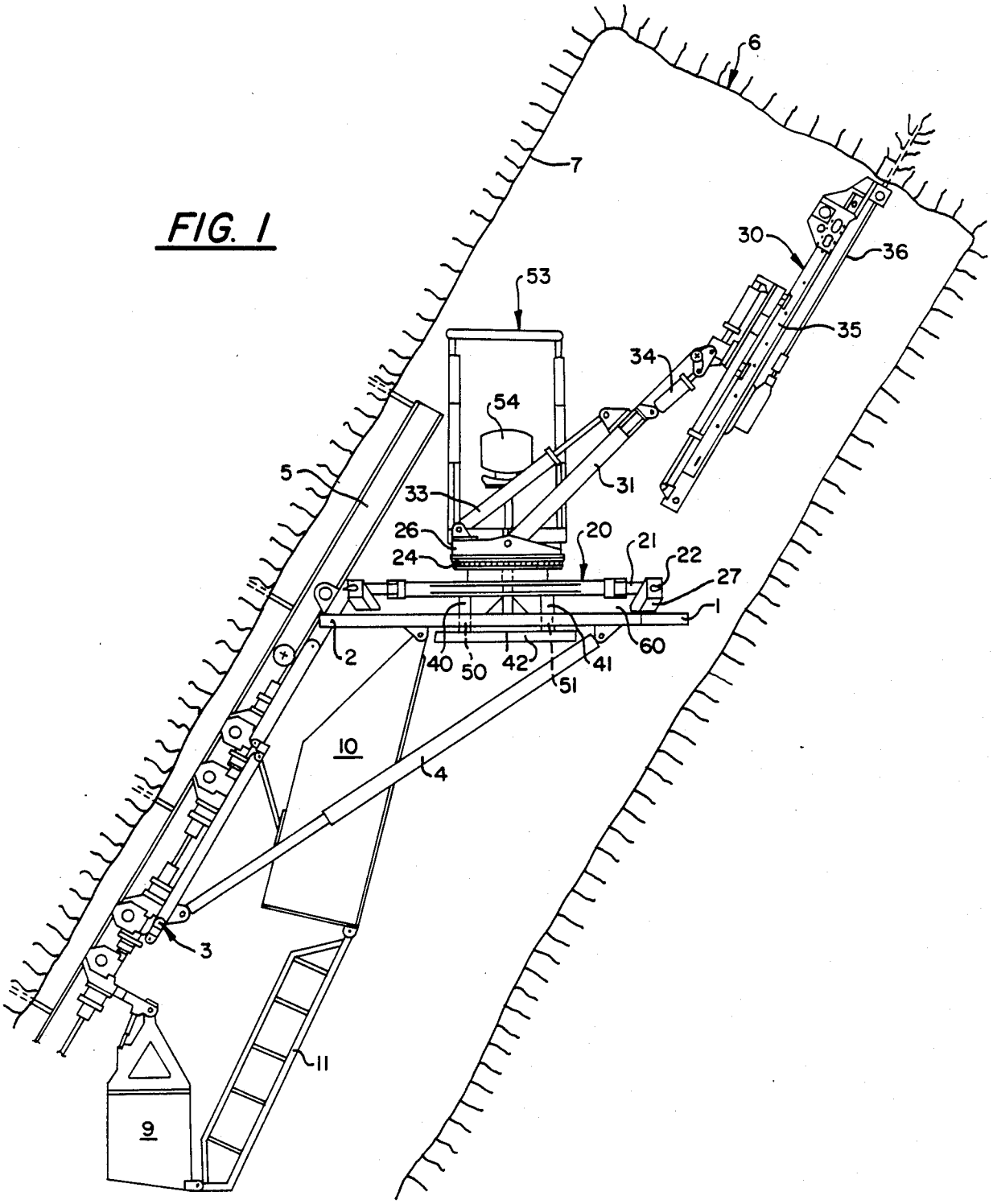
FIG. 1 is a side view of the apparatus embodying principles of the present invention.
Figure 2:
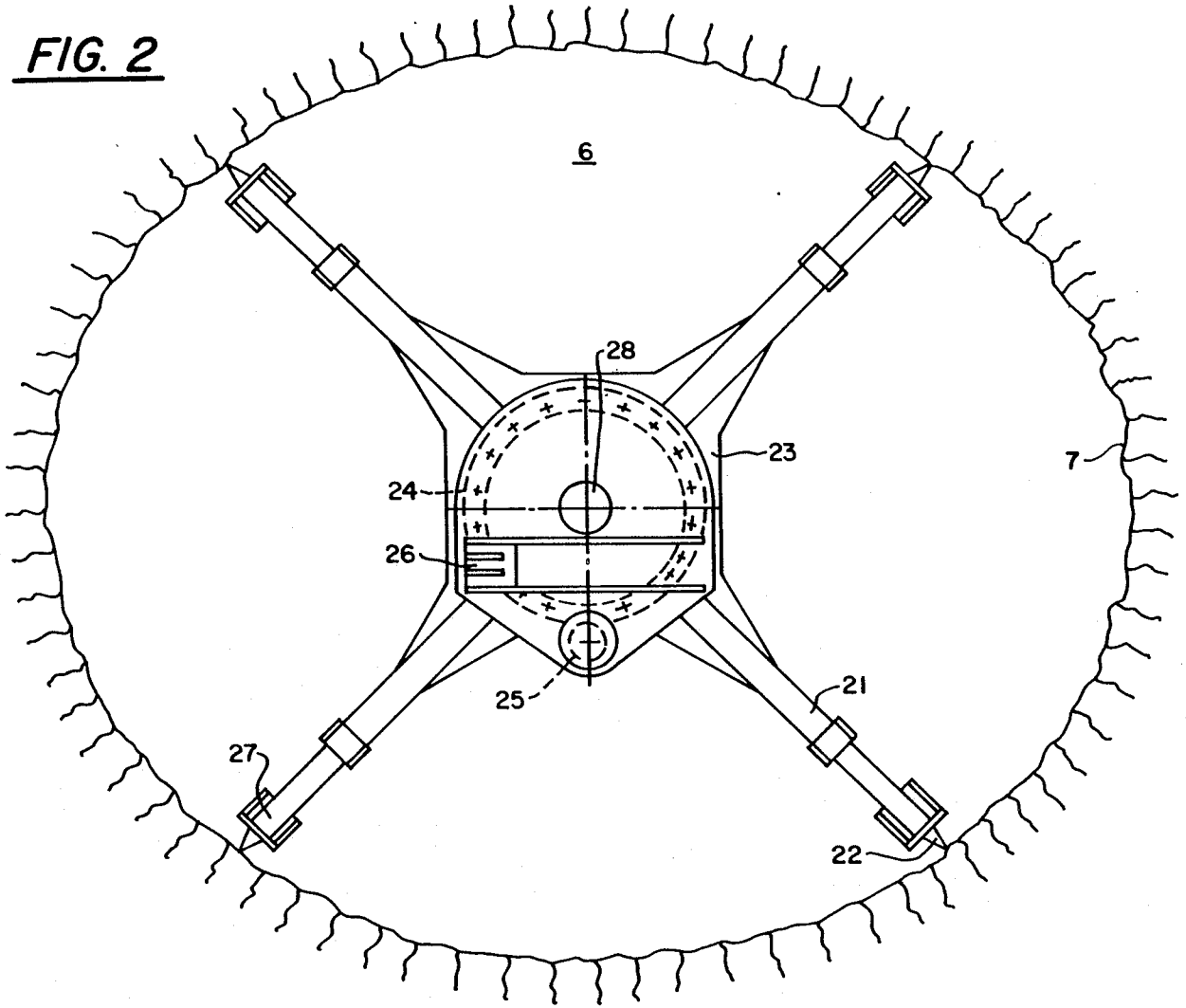
FIG. 2 is a view from above showing a portion of the drilling unit of the apparatus.
Figure 3:
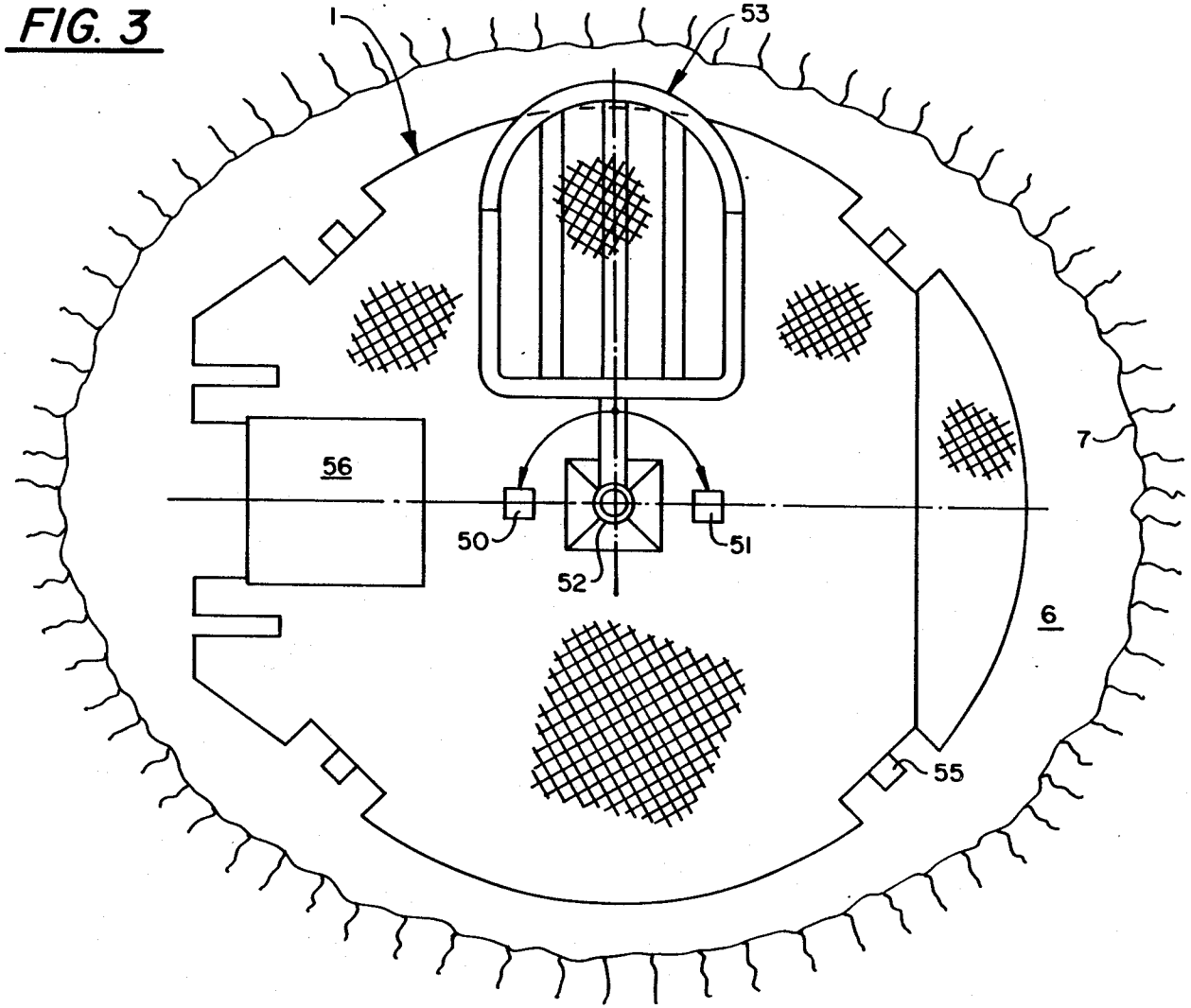
FIG. 3 is a view from above showing the platform of the apparatus, the former carrying the operator's work station and being regulatable in height.

The apparatus includes a platform 1 that can be regulated in height, and which is pivotably connected at a pivot point 2 to an elevator means 3. The slope of the platform may be varied by means of a hydraulic cylinder 4, acting between the means 3 and platform 1.

The elevator means 3 is disposed such that it climbs up along a guide rail 5 anchored to the wall 7 of the shaft 6. The guide rail is extended with new sections as the shaft 6 continues to be driven, so that the reach of the elevator continues to increase in step with driving the shaft. The means 3 is provided with a plurality of toothed wheels or pinions driven by a hydraulic motor for enabling it to climb along the guide rail 5 in a manner known per se, the means 3 also being guided relative the guide rail, on which are arranged teeth for the pinions.

A hydraulic oil source 9, including an electric motor, pump and oil tank, is in communication with the elevator means 3. A personnel transport cage 10 is connected to the platform 1 and elevator means 3, and it is intended to accommodate operators in connection with elevator movements. A ladder 11 is arranged between the hydraulic oil source 9 and the cage 10. The points where the source 9, cage 10 and ladder 11 join on to their surroundings are articulated such as to enable adjusting the slope of the platform 1 in relation to the elevator means 3.

According to the invention, the platform carries a drilling unit 20 with legs that are telescopable, this function being provided with the aid of such as a hydraulically operated telescoping means. At their free ends the legs 21 have tips 22 intended for engagement against the shaft wall 7. The legs depart from a central portion 23 of the drilling unit 20. The central portion 23 carries a toothed swivelling ring 24, which is driven for rotation by a hydraulic motor via a pinion 25. The ring 24 carries a base structure 26, which in turn carries the drilling machine 30 of the drilling unit 20. Via an arm 31 the drilling machine 30 is pivotably connected to the base structure 26. A hydraulic cylinder 33 acts between the base structure 26 and arm 31 for changing the position of the arm so that the drilling machine 30 can assume a desired position. The drilling machine position can also be adjusted by a hydraulic cylinder 34 and by rotating the swivelling ring 24. The drilling machine has a feeder bar 35 and a drill rod 36 for working the rock.

Two brackets 40, 41 depend from the central portion 23, and pass through respective holes 50 and 51 in the platform 1. Under the platform the brackets are connected to a transverse member 42, the function of which will be explained later in more detail.

The platform 1 carries aat its centre a rotatably mounted shaft 52, extending through an opening 28 in the central portion 23 and swivelling ring 24 of the drilling unit 20. The shaft 52 carries a protective cage 53 and seat 54 for the operator above the central portion 23 and swivelling ring 24. The purpose of the cage is, of course, to protect the operator from falling rock.

The platform 1 is further provided with four stubs 55, which are intended for engagement with cavities 27 at the tips 22 of the legs 21.

The platform 1 has a hatch 56 for enabling an operator to move between the transport cage 10 and a work station on the platform.

The apparatus is used and functions in the following manner.

In conjunction with moving the elevator means 3 to the desired position, the drilling unit 20 is fixed to the platform 1 by the unit being positioned such that the stubs 55 on the platform engage with the cavities 27 associated with the legs 21. In addition, the drilling means 30 is positioned in a suitable inactive position, which can be achieved by rotation via the swivelling ring 24 and operation of the hydraulic cylinders 33 and 34. The seat 54 and protective cage 53 should be similarly swung into an inactive position allowing operation of the elevator means without any problems. During the actual elevator movement, the operator is in the transport cage 10. When the elevator means has been moved to its end position, the operator leaves the transport cage, and moves to the platform 1 via the hatch 56. The legs 21 are then telescoped outwards so that their tips 22 engage against the shaft wall 7, and the stubs 55 come out of engagement with the cavities 27. By now lowering the elevator means 3 a short distance, an air gap 60 can be obtained between the drilling unit 20 and platform 1. The transverse member 42 is intended to ensure that the separation of the drilling unit and platform 1 will not be too great. From his seat 54, the operator can now perform his tasks in connection with driving the shaft. Vibration occuring in the drilling unit when the drill rod 36 is working will not be transferred to the platform 1, and thus not to the operator's work station. It should be mentioned that the holes 50, 51 in the platform as well as the opening 28 in the drilling unit 20 have dimensions such that vibrations are not transferred from the drilling unit 20 to platform 1 in these areas. It should also be mentioned that the slope of the platform is of course adjusted before the tips 22 of the drilling unit 20 are urged against the shaft wall 7.

When the operator has completed his tasks, the elevator means is moved upwards to eliminate the gap 60, and the legs 21 are then telescoped inwards to bring the stubs 55 into secure engagement with the cavities 27. The elevator means can now be moved to a new position in height, and the operator can now be in the transport cage 10.

It will be understood from the above that, according to the invention, the platform 1 and drilling unit 20 can be separated a given distance, so that there is an air gap 60 between them for preventing the transfer of vibrations from the drilling unit to the platform when the former is in operation. On the other hand, the drilling unit rests against the platform in conjuction with movement of the elevator means, when there is no air gap and no engagement of the legs 21 against the shaft wall 7.

Electric and hydraulic lines have been excluded from the figures for the sake of clarity, but it will be understood that the hydraulic oil source 9 can be used for operating all hydraulic components.

At the same time, it should be understood that the invention is not dependent on the mentioned hydraulic operation, and other operational power alternatives can be used. The implementation of the elevator means 3 and drilling machine 30 can of course be varied within the scope of the invention. This also applies to the implementation of the operator's work station on the platform 1.

The invention is thus not restricted to what has been illustrated and described, and alterations and modifications thereof are conceivable within the scope of the accompanying claims.

We claim:

1. Apparatus for driving an upwardly directed shaft in rock, thereby providing an increasingly taller shaft having a shaft wall, comprising:

a guide rail for mounting into the shaft wall so as to extend upwards along the shaft;

a platform vertically adjustably mounted to the guide rail for selectabel fixation at a desired height in the shaft;

a drilling unit including leg means which are movable between an extended position in which outer end portions thereof engage the shaft wall for supporting the drilling unit from the shaft wall substantially independently of the platform, and a retracted position in which the outer end portions of the leg means are sufficiently withdrawn from engagement with the shaft wall that the drilling unit is supported on the platform for vertical movement in the shaft as the platform is adjusted so as to become differently selectively fixed at a desired height in the shaft;

said drilling unit further including a drilling machine for cutting rock above said platform for increasing said shaft in height, and means supporting said drilling machine on said leg means, whereby, for preventing the drilling machine, when being operated from transmitting vibrations through said supporting means and said leg means to said platform and via said platform to said guide rail, after said platform has being adjusted in height to place said drilling machine at a level suitable for a cutting operation to begin, said leg means may be moved from said retracted position to said extended position, and said platform vertically adjusted to open a gap between said platform and said drilling unit.

2. The apparatus of claim 1, wherein:

said drilling unit further includes a work station for a person for use while operating said drilling machine.

3. The apparatus of claim 2, wherein:

said drilling unit further includes a cage for protecting a person when occupying said work station from rock falling from said shaft wall.

4. The apparatus of claim 2, wherein:

the means for supporting said drilling machine on said leg means mounts said drilling machine to said work station and provides for rotary movement of said work station relative to said leg means about an axis which is generally perpendicular to said platform, whereby said drilling machine may by swivelled to angularly spaced positions around the shaft.

5. The apparatus of claim 1, wherein:

said drilling unit further includes means engageable with said platform when said platform is moved away from said drilling unit while said leg means are in said extended position, for limiting said gap in vertical extent.

* * * * *